US005244134A

United States Patent [19]

Riley

[11] Patent Number: 5,244,134

[45] Date of Patent: Sep. 14, 1993

[54] STRAP ATTACHMENT FOR A WRIST INSTRUMENT

[75] Inventor: Judith Riley, Waterbury, Conn.

[73] Assignee: Timex Corporation, Middlebury, Conn.

[21] Appl. No.: 860,392

[22] Filed: Mar. 30, 1992

[51] Int. Cl.[5] ..... A44C 5/00

[52] U.S. Cl. ..... 224/164; 224/152

[58] Field of Search ..... 224/152, 164, 165, 166, 224/176, 177, 179, 219, 222, 267; 24/16 PB, 30.5 P, 176, 163 K, 197, 200, 265 WS; 368/281, 282

[56] References Cited

U.S. PATENT DOCUMENTS

| | | | |
|---|---|---|---|
| 2,977,145 | 3/1961 | Rifkin | 24/16 PB |
| 4,178,751 | 12/1979 | Liautaud | 58/23 R |
| 4,462,697 | 7/1984 | Thompson | 368/282 |
| 5,063,615 | 11/1991 | Chernuchin et al. | 24/163 K |

*Primary Examiner*—Henry J. Recla
*Assistant Examiner*—David J. Walczak
*Attorney, Agent, or Firm*—William C. Crutcher

[57] ABSTRACT

A strap attachment for a wristwatch has first and second ends adapted to encircle the wrist of a wearer having a first strap end with a wide strap section and a connecting narrow strap section, and a number of adjustment holes along the wide strap section, and a second strap end terminating in an integral buckle frame with a rectangular frame opening and having a short inclined tang for cooperating with a selected adjustment hole, the strap section with the buckle end having a transverse slot spaced from the buckle frame for receiving the narrow strap section. The buckle frame includes a hard high strength plastic insert overmolded by soft flexible plastic strap material. In a modification, the strap attachment to the watch case comprises an integral central strap section in which an overmolded soft plastic material partially encases a rigid plastic watch case, the latter then being assembled with the movement and sealed from the front side. The strap material may be of PVC or polyurethane and the rigid plastic of polycarbonate with fiberglass filler or ABS.

11 Claims, 3 Drawing Sheets

STRAP ATTACHMENT FOR A WRIST INSTRUMENT

BACKGROUND OF THE INVENTION

Various types of attachments have been used to hold the case of a wrist instrument or timepiece on the wrist of the wearer, such as expansion bands, link bracelets and flexible straps. A popular type of attachment is a strap consisting of two strap halves each of which are attached to lugs on the case of the wrist instrument at one end and which are then buckled together on the other ends. Buckles for watch straps are well known in the art. Ordinarily, one end of the strap is folded around a transverse member on the buckle frame and secured, the transversed member also pivotally supporting the tongue of the buckle which extends through a hole in the strap. The end of the other strap half contains a number of adjustment holes. This end of the strap is inserted beneath another transverse member and the pivotal tongue of the buckle inserted through one of the holes. Then the free end or tongue of the strap is either inserted into a keeper loop on the strap or in some cases beneath a keeper bar on the buckle.

One of the disadvantages with a conventional buckle attachment is that the buckle must be fabricated separately, usually of metal and then attached to a strap. The free end of the strap or tongue then is preferably held against the strap by a keeper loop. However, the end of the strap which extends beyond the keeper loop tends to catch on things. Using a keeper loop also requires an extra piece and more assembly, all of the above adding to the cost of the watch attachment. If spring bars are employed, the extra material and time to attach the strap to the watch case using the spring bars also add to the cost of the attachment.

Suggestions have been made for using a single strap instead two strap halves and molding the central part of the plastic strap around projections or integral protrusions on the watch case, as in the case of U.S. Pat. No. 4,462,697 issued Jul. 30, 1984 to H. B. Thompson and assigned to the present assignee, or utilizing a preformed hard plastic annular insert overmolded with a soft plastic strap material as shown in U.S. Pat. No. 4,178,751 issued Dec. 18, 1979 to Liautaud. The latter patent also utilizes a plastic clasp, wherein the tongue of the watch strap is inserted into a channel-shaped "keeper" enclosure on the other strap half and the length of the strap adjusted by means of lateral opposed ridges and serrations on the mating portions on the strap halves. However, the use of a channel or sheath to act as the keeper, requires extra material.

Improvements in battery life, particularly with the use of lithium energy cells, have made feasible the concept of a disposable wristwatch with a sealed case using a long life energy cell and low cost components so that the wristwatch may be discarded at the end of the battery life. This means that the conventional removable case back to replace the energy cell is no longer necessary and the case of the watch or wrist instrument may be permanently sealed. The need to utilize very low cost components has lead to the search for a strap attachment which does not require a separate buckle and keeper loop.

Accordingly, one object of the invention is to provide an improved strap attachment for a low cost wristwatch.

Another object of the present invention is to provide an improved strap attachment which does not require a separate buckle member.

Another object of the invention is to provide an improved "keeper" for the free end of the strap so it will not catch on anything.

Another object of the present invention is to provide a low cost strap attachment which is suitable for a sealed timepiece case.

SUMMARY OF THE INVENTION

Briefly stated, the invention is practiced by providing a strap attachment having first and second ends adapted to encircle the wrist of a wearer and hold a wrist instrument case on the wrist, comprising a first strap end with a wide strap section and a connecting narrow strap section, having a number of adjustment recesses along the wide strap section and a second strap end terminating in an integral buckle frame with a substantially rectangular frame opening and having a short inclined tang for cooperating with a selected recess, the strap section with the buckle end having a transverse slot spaced from the buckle frame for receiving the narrow strap section. In its preferred form, the buckle frame includes a hard high strength plastic insert overmolded by soft flexible plastic strap material. In another embodiment of the invention, the strap attachment to the watch case comprises an integral central strap section in which an overmolded soft plastic cup partially encases a rigid plastic watch case, the latter then being assembled with the movement and sealed from the front side.

DRAWINGS

These and many other objects will best be understood by reference to the following description taken in connection with the accompanying drawing in which.

Figure 1:
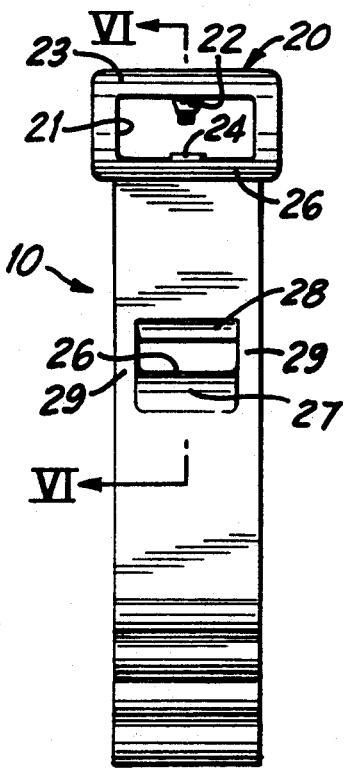
FIG. 1 and FIG. 2 are top plan and side elevational views, respectively of a strap half with conventional spring bar.
Figure 5:
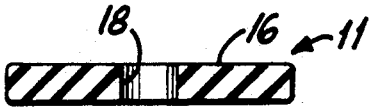
FIG. 5 is an enlarged cross sectional view taken along lines V—V of FIG. 3.
Figure 5A:
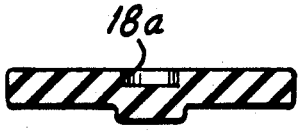
Figure 6:
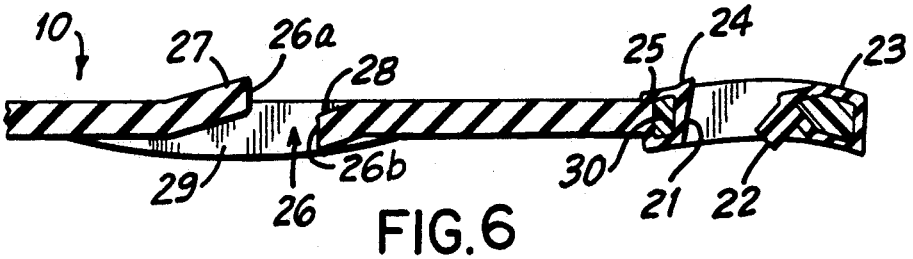
Figure 7:
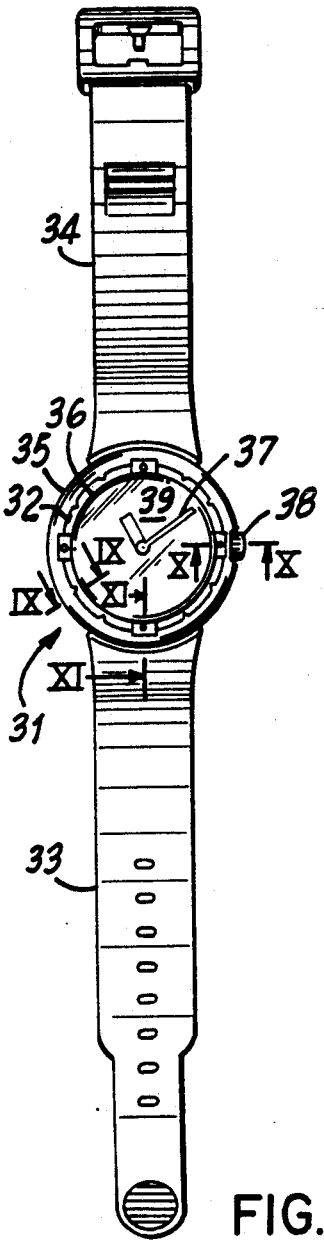
Figure 8:
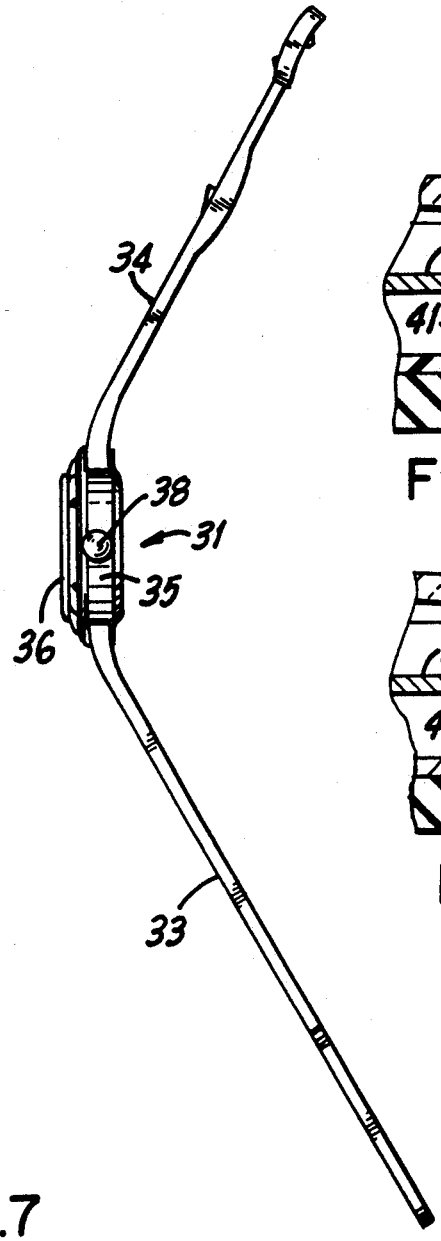
Figure 9:
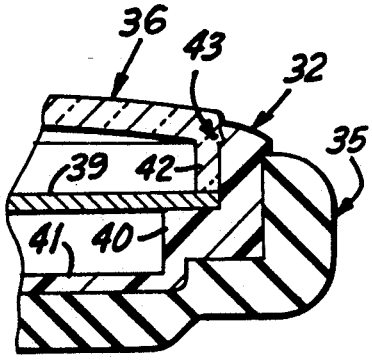
Figure 10:
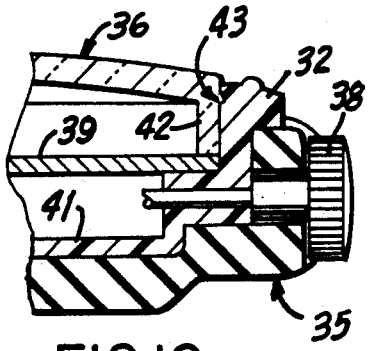
Figure 11:
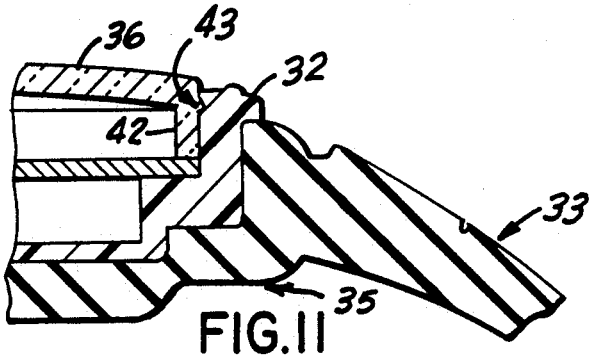
Figure 12:
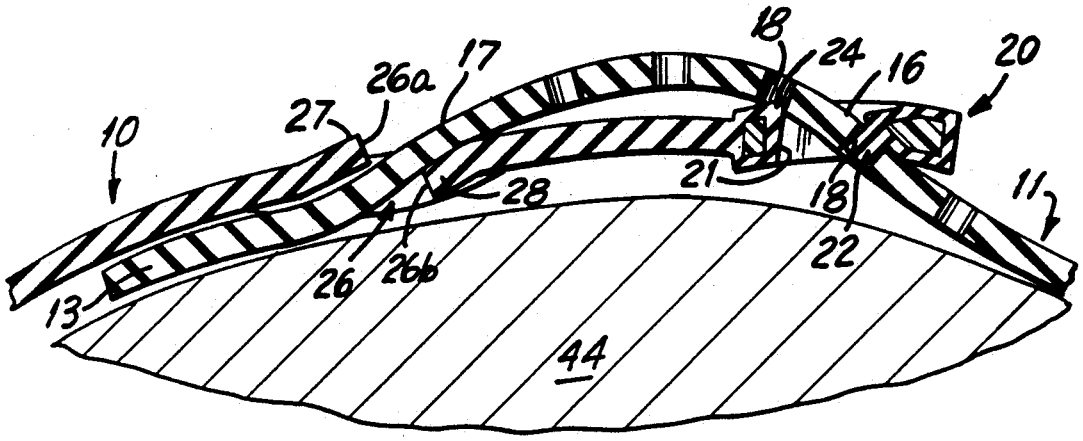

FIG. 5*a* is a similar enlarged cross-sectional view of a modified form of the invention;

FIG. 6 is an enlarged cross elevational view taken along lines VI—VI of FIG. 1;

FIG. 7 and FIG. 8 are top plan views and side elevational view, respectively of a modification of the invention comprising a complete wristwatch having an integral strap attachment; and FIGS. 9, 10, 11 are enlarged partial cross sectional elevational views taken through the watch case and integral strap along the lines IX—IX, X—X and XI—XI, respectively, and FIG. 12 is an enlarged cross-sectional elevational view showing the two strap ends engaged to hold a wrist instrument on the wrist of a wearer.

DESCRIPTION OF THE PREFERRED EMBODIMENT

Figure 2:
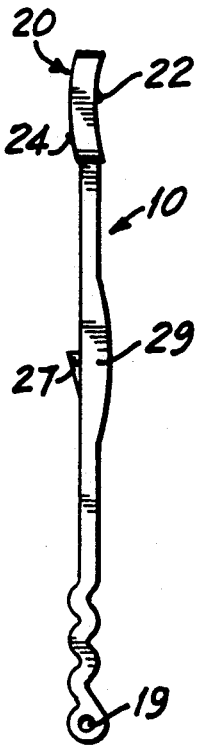
Figure 3:
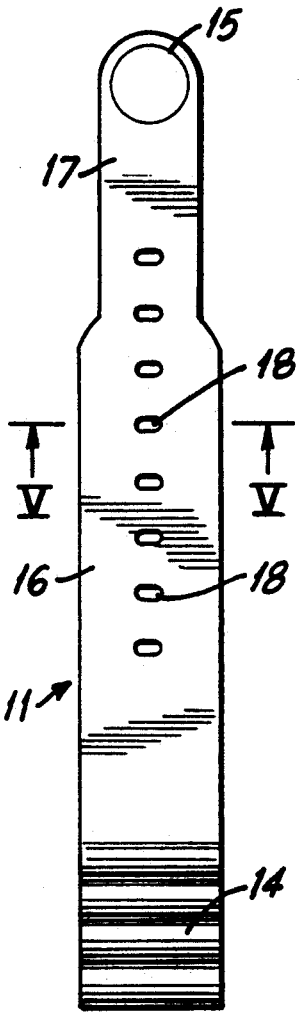
FIG. 3 and FIG. 4 are top plan view and side elevational view, respectively of the other strap half of the strap attachment shown in FIGS. 1 and 2.
Figure 4:
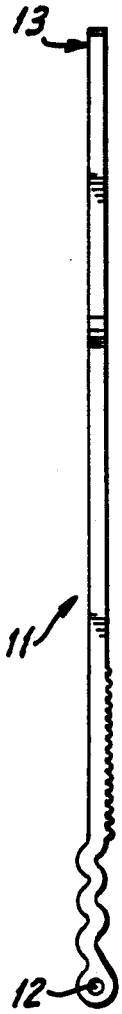

Referring now to the drawing of FIGS. 1–4, FIGS. 1 and 2 illustrate one strap half designated generally as 10 and FIGS. 3 and 4 a mating strap half designated generally as 11. First referring to FIGS. 3 and 4, the strap half 11 is molded from a soft flexible plastic material to incorporate a transverse hole 12 at one end thereof for a conventional keeper bar to be inserted and attached between the lugs of a watch case in the conventional manner, and having at its other or free end a tongue 13. The strap includes an undulating section 14 and a embossed recess 15 on the tongue 13 which are primarily for decorative purposes. Strap 11, in accordance with the present invention, includes a wide strap section 16 tapering to an integral connected narrow strap section 17. A plurality of longitudinally spaced recesses 18 extend longitudinally along part of the watch section 16 and over onto the narrow section 17. Recess 18 extend through the strap, but could also be indentations rather than complete openings.

Referring to the mating strap half 10, it is also molded of soft flexible plastic material with a transverse hole 19 for the keeper bar at one end, and a molded integral buckle frame 20 at the other end. Buckle frame 20 defines a substantially rectangular opening 21 which is transversely wide enough to receive the wide strap section 16. A short inclined integral tang 22 extends from a transverse cross member 23 on the buckle frame. Tang 22 projects generally longitudinally and inwardly as seen in FIG. 2 and is adapted to cooperate with and enter a selected recess 18. Preferably, recesses 18 are full holes so tang 22 can go through the hole, but it is unnecessary for the tang 22 to completely go through the opening provided by recess 18. Buckle frame 20 may further include a secondary tang or protuberance 24 extending generally longitudinally and outwardly from the transverse cross member 25 of the buckle frame. The spacing between tangs 22, 24 is substantially the same as the longitudinal spacing between recesses 18 in the strap half 11. If a secondary tang 24 is used, the recesses are needed on the bottom or underside of the strap. If both of tangs 22, 24 are used, or if longer tangs are used, it is more expedient for recesses 18 to constitute full openings or holes through the strap.

In accordance with the present invention, a transverse slot 26 is longitudinally spaced along the strap half 10 from the buckle frame 20. The transverse slot 26 is selected to be greater than the transverse width of the narrow strap end 17 as seen in FIG. 3. One end wall **26*a* of slot 26 is offset in an outward direction and is molded to provide an outwardly sloping wall 27 and the opposite end wall 26*b* is offset in an inward direction to provide an inwardly sloping wall 28. The terms outward and inward refer respectively to the direction away from and toward the wrist of the wearer. Walls 27, 28 serve as guide walls for the narrow strap end 17. The opposed side walls 29 in the strap on either side of transverse slot 26** are thickened to provide added strength due to the absence of material in the vicinity of the slot.

Reference to FIG. 5 illustrates that holes 18 extend through the full thickness of strap 11. However, it is within the purview of the present invention to use indentations for partial holes or recesses 18 as illustrated in the modified form of the invention at FIG. **5*a* by the indentations 11*a***.

Referring to FIG. 6 of the drawing, the enlarged view illustrates a cross section taken along lines VI—VI in FIG. 1 showing the spaced oppositely directed sloping walls 27, 28 on either end of transverse slot 26, as well as illustrating the thickened side walls 29 in the vicinity of the slot. Referring to the buckle frame 20, the preferred embodiment of the invention employs a rectangular frame insert 30 of rigid plastic material, which is overmolded by the soft flexible material of the strap proper. This may be carried out using a "two-shot" molding process. A preferred material for the frame insert 30 is polycarbonate with a 20% fiberglass filler. An alternate material is rigid ABS (acrylonitrile-butadiene-styrene). The preferred material for the strap proper is flexible PVC (polyvinyl chloride). An alternative material for the strap proper is flexible polyurethane, or other suitable synthetic elastomer.

Referring now to FIGS. 7 and 8 of the drawing, a modified form of the strap attachment is shown which uses the same buckle attachment for the free ends of the strap as previously described in connection with FIGS. 1–6. Here, however, rather than using conventional spring bar attachments to fasten two strap halves to the case of the wrist instrument, the strap member is molded in one piece and includes a soft or supple central strap section which partially encases the back and sides of a watch case of rigid high strength plastic material.

The wrist instrument, here an analog wristwatch, is shown generally at 31 in FIGS. 7 and 8 to comprise a watch case 32 of rigid plastic material, a first strap end 33 and a second strap end 34 joined by an integral central strap section 35 which partially encases the watch case 32. Conventional elements for an analog wristwatch further include a clear plastic lens 36 for viewing the hands 37 and a manual crown 38 for setting the time as indicated on a watch dial 39. The movement is omitted in the drawing, but may be mechanical or electrical. The analog watch is illustrative of wrist instruments of all types.

The enlarged cross sectional views of FIGS. 9, 10 and 11 taken at the locations indicated on FIG. 7 illustrate the construction. Watch case 32 includes peripheral side walls 40 containing the movement (not shown) and an integral case back wall 41. Watch dial 39 rests on a ledge in side walls 40 and is held in place by a peripheral flange 42 on watch lens 36, the latter being held with a snap connection 43 in case 32. Alternatively, ultrasonic welding can be employed.

Case 32 is molded of rigid plastic material such as polycarbonate or ABS as part of a two shot molding process, wherein it is overmolded with flexible plastic material of the strap proper. The periphery and case back of watch case 32 are enveloped and overmolded by the central portion 35 of the integral strap. The latter is comprised of soft flexible polyvinyl chloride or polyurethane. The wrist instrument is then assembled from the open front end. When assembled and closed with lens 36 it comprises a sealed watch case.

Reference to the cross section of FIG. 10 illustrates a construction similar to FIG. 9, except that the manual crown 38 for setting the watch is shown entering sealed openings in the strap central section 35 and watch case 32, respectively.

Reference to the cross section of FIG. 11 shows elements similar to FIGS. 9 and 10, but further illustrates that the central strap section 35 merges into the strap ends, as illustrated by part of the strap end 33.

Referring to FIG. 12 of the drawing, the assembled improved strap attachment is shown in cross section on the wrist, partially illustrated at 44 of a wearer. The first strap end 11 is shown attached to the second strap end 10 by passing the tongue 13 of the first strap end 11 through the opening 21 in the buckle frame 20 and selectively adjusting the strap length by positioning the wide strap section 16 in opening 21 so that tang 22 locates the position of strap.

Tang 22 enters the recess 18 from the outer or upper part of the strap, but does not go through the strap. The tang merely interferes with longitudinal movement of the strap. However, in some designs a longer tang may be used so that it extends through a full hole in the strap.

The end of narrow strap section 17 is then inserted through the transverse slot 26, guided by the sloping walls 27, 28. The free end or tongue 13 of the narrow strap section is thereby held between the outer strap section and the wrist 44. Transverse slot 26 therefore acts as a keeper and since the end 13 of the strap is between the other strap end and the wrist, it cannot catch on anything. Frictional engagement between the strap ends prevents disengagement of the buckle frame. Additional security is provided by the secondary tang 24 which is so located as to engage an adjacent one of the adjustment recesses 18 from the underside of the strap.

By using an integral buckle frame, preferably reinforced with an overmolded rigid plastic insert for strength, and by utilizing a transverse slot to serve as a keeper by retaining the narrow end of the other strap half, a very inexpensive strap attachment is achieved.

Furthermore, when the strap attachment is extended to an integral strap member with a central section overmolding and partially encasing a rigid plastic watch case, a strap attachment is adapted to provide an inexpensive disposable timepiece, which can be assembled and sealed from the front side.

While there has been described herein what it considered to be the preferred embodiment of the invention, along with modifications thereof, it is desired to secure in the appended all such modifications as fall within the true spirit and scope of the invention.

I claim:

1. An improved strap attachment adapted for holding a wrist instrument, said strap attachment having first and second ends with outward and inward sides and adapted to encircle the wrist of a wearer on their inward sides to hold said wrist instrument on said wrist, comprising:

a first strap end having a wide strap section and connecting narrow strap section terminating in a free end of said first strap end, said first strap end defining a plurality of longitudinally spaced recesses along portions of said wide and narrow strap sections;

a second strap end having a second strap section terminating in an integral buckle frame defining a frame opening therein, said frame opening having a wider transverse dimension than said wide strap section and further defining at least one short rigid tang arranged to cooperate with and enter a selected one of said recesses for selectively adjusting the position of said wide strap section in said frame opening, said second strap section defining a transverse slot therethrough longitudinally spaced from said buckle frame, said slot having a wider transverse dimension than said narrow strap section, whereby said narrow strap section may be inserted therethrough to serve as a keeper to retain the free end of said narrow strap section between said second strap section and said wrist of a wearer.

2. The combination according to claim 1, wherein said integral buckle frame is substantially rectangular and includes spaced transverse cross members.

3. The combination according to claim 2, wherein said first and second strap end are molded of flexible plastic material, and further including a rigid substantially rectangular frame insert of hard plastic material within said substantially rectangular buckle frame, said frame insert being overmolded by said flexible plastic material.

4. The combination according to claim 1, and further including a central strap section integral with said first and second strap ends, said central strap section adapted for attachment to a wrist instrument case having back and peripheral walls, and further adapted to partially encase said peripheral walls and back of said wrist instrument case.

5. The combination according to claim 1, wherein said buckle frame comprises a first transverse cross piece defining said tang at the center thereof, said tang being inclined so as to be directed both longitudinally and inwardly toward the wrist of the wearer, said recesses being defined on the outward side of said first strap end.

6. The combination according to claim 5, wherein said buckle frame defines a second transverse cross piece spaced from said first transverse cross piece, said second transverse cross piece defining a secondary tang, said secondary tang being inclined so as to be directed substantially longitudinally and upwardly away from the wrist of a wearer, said recesses being also defined on the inward part of said first strap end.

7. The combination according to claim 1, wherein said transverse slot includes first and second end walls which are offset outwardly, and inwardly respectively to provide sloping guide walls on the inner and outer sides respectively of said second strap end to direct and guide the narrow strap section.

8. The combination according to claim 1, wherein said second strap end defines side walls on either side of said transverse slot which are thicker than the remaining portions of said second strap end to provide added strength in the vicinity of the transverse slot.

9. The combination according to claim 3, wherein said flexible plastic material is selected from the group consisting of flexible PVC and polyurethane and wherein said hard plastic material is selected from the group consisting of polycarbonate and ABS.

10. The combination according to claim 3, wherein said flexible plastic material is flexible PVC and wherein said hard plastic material is polycarbonate.

11. An improved strap attachment having first and second ends with outward and inward sides and adapted to encircle the wrist of the wearer on their inward sides to hold a wrist instrument case on said wrist, said strap attachment being molded of flexible soft plastic material, comprising:

a first strap end having a wide strap section and a connecting narrow strap section terminating in a free end of said first strap end, said first strap end defining a plurality of longitudinally spaced holes along the center of said wide strap section;

a second strap end having a second strap section terminating in an integral substantially rectangular buckle frame defining a substantially rectangular frame opening therein and having first and second spaced transverse cross members, said frame opening having a wider transverse dimension than said wide strap section, said buckle frame incorporating an overmolded rigid frame insert of hard plastic material and further defining at least one short rigid tang arranged at the center of said first transverse cross member to cooperate with and enter a selected one of said holes for selectively adjusting the position of said wide strap section in said frame opening, said second strap section defining a transverse slot therethrough longitudinally spaced from said buckle frame, said slot having a wider transverse dimension than said narrow strap section, said slot further having end walls which are offset inwardly and outwardly from one another, wherein sloping guide walls are provided to receive and guide the narrow strap section, whereby said narrow strap section may be inserted through said transverse slot to serve as a keeper to retain the free end of said narrow strap section between said second strap section and said wrist of a wearer and to prevent disengagement of said short rigid tang from said selected hole.

* * * * *